US007548211B2

(12) United States Patent
Platz

(10) Patent No.: US 7,548,211 B2
(45) Date of Patent: Jun. 16, 2009

(54) WIRELESS AUDIO SIGNAL RECEIVER DEVICE FOR A HEARING INSTRUMENT

(75) Inventor: Rainer Platz, Colombier (CH)

(73) Assignee: Phonak AG, Staefa (CH)

( * ) Notice: Subject to any disclaimer, the term of this patent is extended or adjusted under 35 U.S.C. 154(b) by 449 days.

(21) Appl. No.: 11/277,978

(22) Filed: Mar. 30, 2006

(65) Prior Publication Data

US 2007/0229369 A1 Oct. 4, 2007

(51) Int. Cl.
*H01Q 1/12* (2006.01)

(52) U.S. Cl. ..... 343/718; 343/702; 343/741; 343/866

(58) Field of Classification Search ..... 343/718, 343/741, 866, 702
See application file for complete search history.

(56) References Cited

U.S. PATENT DOCUMENTS

| | | | | |
|---|---|---|---|---|
| 5,812,598 | A | 9/1998 | Sharma et al. | |
| 6,891,506 | B2 * | 5/2005 | Jarmuszewski et al. | 343/702 |
| 2001/0011012 | A1 | 8/2001 | Hino et al. | |
| 2005/0099341 | A1 * | 5/2005 | Zhang et al. | 343/700 MS |
| 2005/0232454 | A1 | 10/2005 | Niederdrank et al. | |
| 2006/0227989 | A1 * | 10/2006 | Polinske | 381/322 |
| 2007/0080889 | A1 * | 4/2007 | Zhang | 343/895 |

FOREIGN PATENT DOCUMENTS

| | | | |
|---|---|---|---|
| DE | 3742877 | A1 | 6/1989 |
| DE | 10 2004 017 832 | B3 | 10/2005 |
| DE | 10 2004 016 573 | B3 | 11/2005 |
| EP | 1 376 760 | A2 | 1/2004 |
| EP | 1471596 | A1 | 10/2004 |
| EP | 1 531 649 | A2 | 5/2005 |
| EP | 1 594 187 | A1 | 11/2005 |
| WO | 2005 069432 | A1 | 7/2005 |
| WO | 2005081583 | A1 | 9/2005 |

* cited by examiner

*Primary Examiner*—Tho G Phan
(74) *Attorney, Agent, or Firm*—David S. Safran; Roberts Mlotkowski Safran & Cole, P.C.

(57) ABSTRACT

A receiver device (10) for receiving audio signals from a remote source is provided, comprising: a magnetic loop antenna for receiving radio frequency signals carrying audio signals, a signal processing unit for reproducing audio signals from the radio frequency signals received by the antenna, an output interface which is capable of being mechanically connected to an input interface of a hearing instrument to be worn at a user's ear in order to supply the audio signals from the signal processing unit as input to the hearing instrument, and a housing enclosing the antenna and the signal processing unit, wherein the antenna is designed as a printed board circuit with a loop-like conductor on an at least partially flexible insolating substrate and comprises a first portion defining a first plane and a second portion defining a second plane, wherein the first plane and the second plane are oriented at an angle of 60 to 120 degrees relative to each other.

12 Claims, 7 Drawing Sheets

WIRELESS AUDIO SIGNAL RECEIVER DEVICE FOR A HEARING INSTRUMENT

BACKGROUND OF THE INVENTION

1. Field of the Invention

The present invention relates to a wireless receiver device for wirelessly receiving audio signals from a remote source, which is capable of supplying such audio signal to a hearing instrument. The invention also relates to a hearing instrument which is capable of wirelessly receiving audio signals from a remote source.

2. Description of Related Art

It is well-known to use a receiver device (usually an FM (frequency modulation) receiver) for receiving audio signals from a remote source, for example a remote microphone, via a wireless link (usually an FM link) in order to provide such audio signals as input signals to a hearing instrument worn at a user's ear. To this end the receiver device has an output interface which is capable of being mechanically connected to an input interface of the hearing instrument via a so-called "audio shoe". The audio shoe is mechanically connected to the input interface of the healing aid and comprises typically a standardized 3-pin socket for receiving three mating pins of the output interface of the receiver device, which pins typically are arranged in a line. However, the orientation of the three pins in the audio shoe with respect to the hearing instrument, i.e. with respect to the user's head, is not standardized and therefore varies from type to type. Moreover, the sensitivity of the antenna of the receiver device depends on the relative orientation to the user's head, with the optimum orientation of the antenna being given if the loop surface is perpendicular to the direction of the user's nose. If the receiver device is turned by 90°, the loss in sensitivity is typically of the order of 6 dB.

A presently used solution to this problem is to provide for a mechanical construction which allows to orient the receiver device in the optimum direction for all types of hearing instruments, wherein the connector, i.e. the mechanical components of the output interface of the receiver unit (i.e. the three pins), is rotatable with respect to the housing of the receiver device, so that prior to plugging the receiver unit into the audio shoe the connector can be rotated in an appropriate manner so as to adapt the orientation of the receiver device to the specific type of audio shoe/hearing instrument. Such receiver devices are sold, for example, by Phonak Communications AG, Murten, Switzerland, under the product designation MLx S.

A drawback of this solution is that a rotatable connector results in larger dimensions of the receiver device, given by the space required to design and implement a reliable and stable mechanical solution for the connector rotation. In addition, the electrical connections between the connector and the electronic module of the receiver device need to be flexible in order to allow the rotation of the connector with respect to the electronic module, which results in additional complexity, e.g. soldered wires, and again larger geometrical dimensions. A further drawback is the need to instruct the user regarding how to manipulate the receiver device, i.e. how to rotate the connector, on all sorts and types of combinations of hearing instruments and audio shoes.

EP 1 531 649 A2 describes a wireless hearing aid system with a magnetic loop antenna on a flex print, wherein at least a portion of the matching network is affixed to the flexible dielectric substrate carrying the antenna. The antenna may be attached to the inner or outer surface of the shell of the heating aid, with the shape of the loop antenna being matched to the irregular shape of the hearing aid shell.

DE 10 2004 017 832 B3 relates to a hearing aid having a housing into which an antenna is integrated as an electrically conducting layer in order to reduce the size of the hearing aid. The antenna may be L-shaped as a metal layer applied to the hearing aid housing, the antenna may be applied as a pre-shaped foil element onto the hearing aid housing, the antenna may be produced by structuring a metal layer of the hearing aid housing or the antenna may be fabricated as a conducting plastics layer during injection moulding of the hearing aid housing.

EP 1 376 760 A2 relates to a folded dipole antenna for transmitting and receiving radio signals in all types of telecommunication systems, in particular for use in base stations of mobile telephone networks. The antenna consists of three portions, namely a central portion fixed to a ground plate, a left portion and a right portion which are angled by 45° to the central portion in such a manner that they form an angle of 90° relative to each other.

EP 1 594 187 A1 relates to a folded laminar antenna which is designed as a slot-loop antenna with a loop-like slot between conducting portions. The antenna consists of three portions, namely a central portion, a right portion and a left portion, with the right and left portions being folded by about 180° onto the central portion. The antenna comprises a layer of electrically conductive material which is provided on a dielectric substrate layer. The antenna may be used in portable wireless devices such as mobile telephones and personal digital assistants.

DE 10 2004 016 573 B3 relates to a binaural In-the-ear (ITE) hearing aid system wherein each of the two hearing aids has an antenna for wireless communication with the other hearing aid and wherein the antenna is oriented at a certain angle with respect to the housing in order to ensure that the two antennas are aligned when the hearing aids are worn by the user.

It is a first object of the invention to provide for a receiver device for being used with a hearing instrument, wherein the dependence of the sensitivity of the receiver device on the specific type of the hearing instrument should be relatively low while nevertheless the receiver device should be mechanically relatively simple.

It is a second object of the invention to provide for a receiver device for being used with a hearing instrument. wherein particularly simple manufacturing of the receiver device should be enabled.

It is a third object of the invention to provide for a hearing instrument capable of receiving audio signals from a remote source, wherein the space required by the antenna should be minimized.

SUMMARY OF THE INVENTION

According to the invention the first object is solved by a receiver device having an antenna that is defined as a printed board circuit with a loop-like conductor on an at least partially flexibe insulating substrate and comprises a first portion defining a first plane and a second portion defining a second plane, the first and second planes in being oriented at an angle of 60 to 120 degrees relative to each other and whereas the third object is achieved by a hearing instrument having an antenna that is designed as a printed board circuit with a loop-like conductor on an at least partially flexible insulating substrate and comprises a first portion defining a first plane and a second portion defining a second plane, the first and second planes being oriented at an angle of 60 to 120 degrees relative to each other.

By using a magnetic loop antenna which comprises a first portion defining a first plane and a second portion defining a second plane, wherein the first plane and the second plane are oriented at an angle of 60 to 120°, it is ensured that at least one portion of the antenna is always oriented at least close to the optimum direction, whatever the actual orientation of the receiver device—depending on the type of hearing instrument to which it is to be connected—on the user's head will be. In addition, in view of the fact that usually the housing of such receiver device will have walls which are oriented relative to each other at an angle of typically between 60 and 120° the geometry of the magnetic loop antenna can be adapted to the geometry of the housing, whereby the volume of the receiver device can be reduced. In particular, also the need for a rotatable connector is avoided. Consequently, a more simple, smaller, more compact and also more robust receiver device can be achieved.

By providing a magnetic loop antenna which comprises a first portion defining a first plane and a second portion defining a second plane, wherein the first plane and the second plane are oriented at an angle of 60 to 120°, a relatively small, compact and robust hearing instrument can be achieved.

In a preferred embodiment, the first portion of the antenna is adjacent and aligned to a first wall of the housing and the second portion of the antenna is adjacent to and aligned to a second wall of the housing in order to achieve a particularly compact design. Preferably the first and second portion of the antenna are planar.

Preferably the first and second portion of the antenna unit are connected by a bent portion of the antenna unit, with the first and second portion of the antenna unit preferably comprising at least 80% of the area of the antenna. Preferably the first and second portion of the antenna have essentially the same area and are essentially symmetrical with respect to each other.

Preferably the angle between the first plane and the second plane is approximately 90°, for example from 80 to 100°.

In the case in which the antenna unit is designed as a printed board circuit with a loop-like conductor layer on a flexible insulating substrate, the device is preferably manufactured by forming the loop-line conductor layer on the flexible insulating substrate while the substrate is in a planar condition, bending the first and second portion relative to each other such that the first plane and the second plane become oriented at an angle of 60 to 120° and fixing the first and second portion in that orientation to each other, and mounting the antenna unit and the signal processing unit within the housing. Preferably the antenna unit and the signal processing unit are electrically connected prior to mounting the antenna unit and the signal processing unit within the housing, with the antenna unit and a preamplifier of the signal processing unit being tuned prior to mounting the antenna unit and the signal processing within the housing.

In the case in which the antenna unit is formed by an angled portion of the housing, the device is preferably manufactured by forming the housing with the integrated antenna unit and mounting the signal processing unit within the housing. Preferably the antenna unit is integrated into the housing by a moulded interconnect device (MID) technique.

According to one embodiment, the housing is shaped first and subsequently the antenna unit is integrated into the housing by modifying the surface of the housing. Preferably, the plastic material is capable of being made conductive by laser activation and the loop-like conductor is created by laser activation of a surface portion of the plastic material of the housing, followed by electroplating of the laser-activated surface portion in order to thicken the laser-activated surface portion.

According to an alternative embodiment the loop-like conductor is created by metal deposition from a metal evaporation source through a shadow mask onto a surface portion of the plastic material of the housing.

According to a further alternative embodiment the loop-like conductor is created by coating at least a portion of the surface of the housing with a metal layer, followed by selectively structuring the metal layer in order to create a loop-like metal structure, wherein the metal layer preferably is structured by selectively removing the metal layer.

According to another alternative embodiment the antenna is integrated into the housing during shaping of the housing, wherein the housing preferably is shaped by injection moulding in a moulding tool, wherein the loop-like conductor is inserted into the moulding tool and is overmoulded in the moulding tool.

By orienting the antenna plane or antenna direction, respectively, at an angle of 30 to 60 degrees, preferably at 40 to 50 degrees, with respect to the central symmetry plane of the output interface, it is ensured due to the fact that the orientation of the input interface or the adapter interface (audio shoe) typically differs by ±90 degrees or ±180 degrees from type to type of the hearing instrument so that also the relative orientation of the receiver device when connected to the hearing instrument would differ by 90 degrees or 180 degrees depending on the type of hearing instrument—that the orientation of the antenna to the user's head anatomy, in particular to the direction of the user's nose, differs by significantly less than 90 degrees depending on the type of hearing instrument so that the worst case in which the antenna is oriented more or less parallel to the direction of the user's nose can be avoided.

Usually said output interface comprises three pins which are arranged in a line, with these pins defining the central symmetry plane. The antenna may be a magnetic loop antenna, a ferrite coil antenna or an air coil antenna.

Furthermore, by forming a printed board circuit antenna and at least a portion of the signal processing unit as an integral electronic unit on a common printed circuit board comprising an at least partially flexible insolating substrate which is capable of being partially folded for mounting the printed circuit board into the housing, manufacturing of the receiver device is made particularly simple, since the antenna and at least a portion of the signal processing unit can be processed as an integral electronic unit, while, due to the foldability of the substrate, nevertheless a compact design can be achieved.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
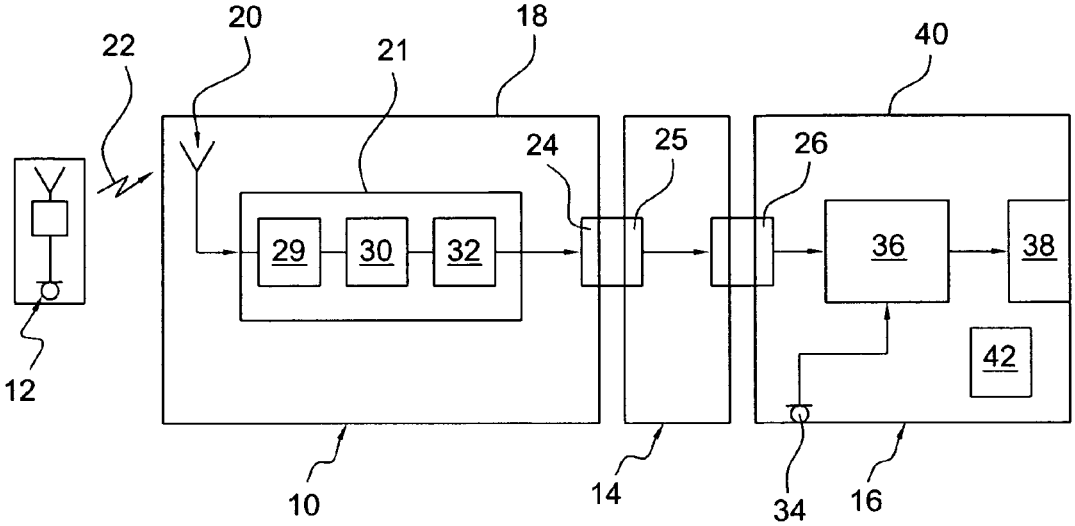
FIG. 1 is a block diagram of an embodiment of a receiver device according to the invention when connected with a hearing instrument.

FIG. 1 shows a block diagram of a receiver device 10 capable of wirelessly receiving audio signals from a remote source 12, which is connected via an audio shoe 14 to a healing instrument 16 which may be a behind-the-ear (BTE) hearing aid which is worn at the user's ear. The remote audio signal source typically may be a transmitter unit comprising a microphone which is worn by a teacher in a classroom for teaching hearing-impaired pupils.

The receiver device 10 comprises a housing 18, a magnetic loop-antenna 20 for receiving radio-frequency signals carrying audio-signals from the remote source 12 via a radio-frequency link 22, a signal processing unit 21 for reproducing audio signals from the radio frequency signals received by the antenna 20, and an output interface 24 which is capable of being mechanically connected to an input interface 26 of the hearing instrument 16 via the audio shoe 14 which comprises an input interface 25 mating with the output interface 24. The signal processing unit 21 comprises a high frequency (HF) unit 29 connected to the antenna 20, a demodulator 30 for demodulating the frequency-modulated (FM) signal received by the antenna 20 and processed by the HF-unit 29, and a pre-amplifier 32 for pre-amplifying the demodulated audio signal prior to being passed to the output interface 24. The HF-unit 29 usually comprises a matching network for the antenna 20, an low-noise amplifier, an RE-amplifier, a frequency synthesiser and a mixer in order to convert the HF-signal received by the antenna 20 down an intermediate frequency. The architecture of the receiver device described so far is conventional FM receiver architecture.

The hearing instrument 16 comprises at least one microphone 34, a signal processing unit 36, an output transducer 38 (e.g. a loudspeaker) for stimulating the user's hearing, and a housing 40 and a battery 42 which typically also serves to power the receiver device via the audio shoe 14. When being used with the receiver unit 103 the hearing instrument 16 usually will have two different modes of operation: a first mode in which only the input audio signal received from the receiver device 10 is reproduced by the output transducer 38 (usually labelled "FM" mode) and a second mode in which a combination of the signal of the microphone 34 and the input signal provided by the receiver device 10 is reproduced by the output transducer 38 (usually labelled "FM+M" mode).

Figure 2:
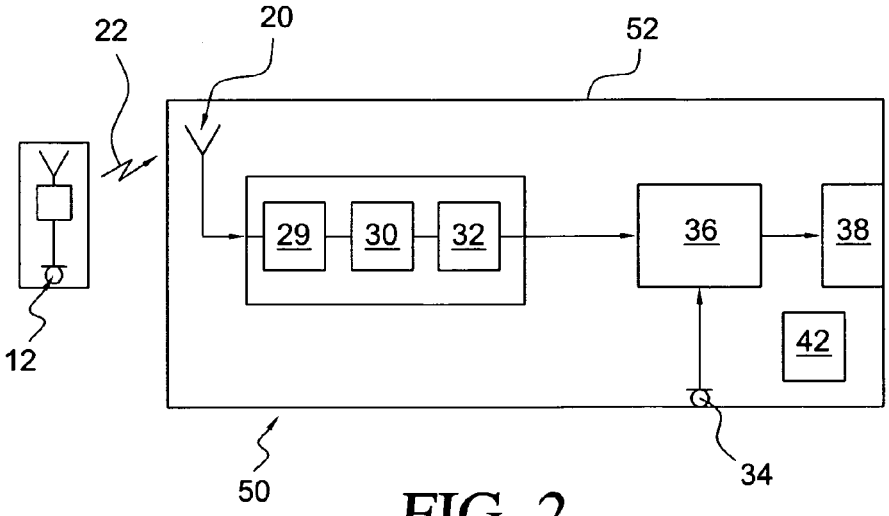
FIG. 2 is a block diagram of an embodiment of a hearing instrument according to the invention which is capable of receiving audio signals from a remote source.

FIG. 2 is a block diagram of a hearing instrument 50, for example, a BTE hearing aid, which is capable of receiving audio signals form a remote source 12 via an FM link 22. To this end, a magnetic loop antenna unit 20 and a first signal processing unit 21 comprising a HF-unit 29, a demodulator 30 and a preamplifier 32 are integrated within the housing 52 of the hearing instrument 50. The system of FIG. 2 is functionally equivalent to the system shown in FIG. 1 in that audio signals from the remote source 12 can be provided to the user wearing the hearing instrument via the output transducer 38, with the functional components of the receiver device 10 of FIG. 1 being mechanically integrated within the hearing instrument 50.

Figure 3:
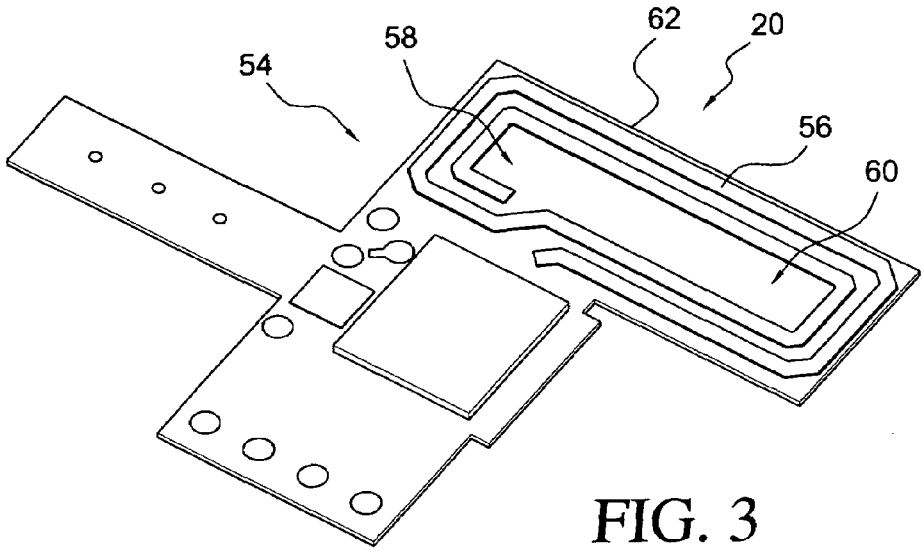
FIG. 3 shows a flexprint assembly comprising an antenna for use in a receiver device to be connected to a hearing instrument or in a hearing instrument, with the assembly being shown in its original unfolded state.

In FIG. 3 an example of an antenna 20 to be used for the receiver device 10 of FIG. 1 or the hearing instrument 50 of FIG. 2 is shown. The antenna 20 is part of an assembly 54 comprising a printed circuit board 53 which comprises an insulating substrate 55 which is flexible such that it is capable of being bent by at least 90°. As an alternative, the insulating substrate 55 may comprise rigid portions which are connected by flexible portions, i.e. in this case the substrate is only partially flexible. The assembly 54 comprises a loop-like conductor 56 on the insulating substrate 55, which forms two turns in order to form a magnetic loop antenna (however, also one turn may be already sufficient or three turns may be needed to achieve the optimum impedance). The area surrounded by the conductor turns should be as large as possible. The antenna 20 needs to have low resistance, which may be achieved by metalizing all layers of the print (or at least the uppermost layer and the lowermost layer (for a single layer print)) and realizing a conductive connection therebetween through an appropriate number of metalized via holes.

In addition to the antenna 20 the assembly 54 includes other electronic components 57 (ICs and passive components) forming at least part, preferably all, of the signal processing unit. In particular, the assembly will include at least the components of the HF-unit 29. Some of such electronic components 57 may be formed directly on the substrate 55 as conductor layers while others may be mounted as separate components on the substrate 55. The electronic components 57 formed directly on the substrate 55 may be formed in the same processing step as the antenna 20, whereas the separate components will be mounted thereafter. Thus the assembly 54 serves as an integral electronic unit, i.e. as an electronic module.

In FIG. 3 the assembly 54 is shown in a planar condition after manufacturing.

The antenna 20 comprises a first portion 58 and a second portion 60 which are connected by an intermediate portion 62 which allows the first and second portion 58, 60 to be folded with respect to each other so that they form an angle of, e.g. 90°, with the intermediate portion 62 being bent. The intermediate portion 62 may be of the same material as the first and second portion 58, 60 (if these are made of sufficiently flexible material) or it may be of a more flexible material of the substrate 55.

In addition, the assembly 54 comprises other portions 59, 61 carrying electronic components 57, which are foldable be about 90 degrees or 180 degrees relative to a central portion 63 in order to minimize the space required by the assembly 54.

Figure 4:
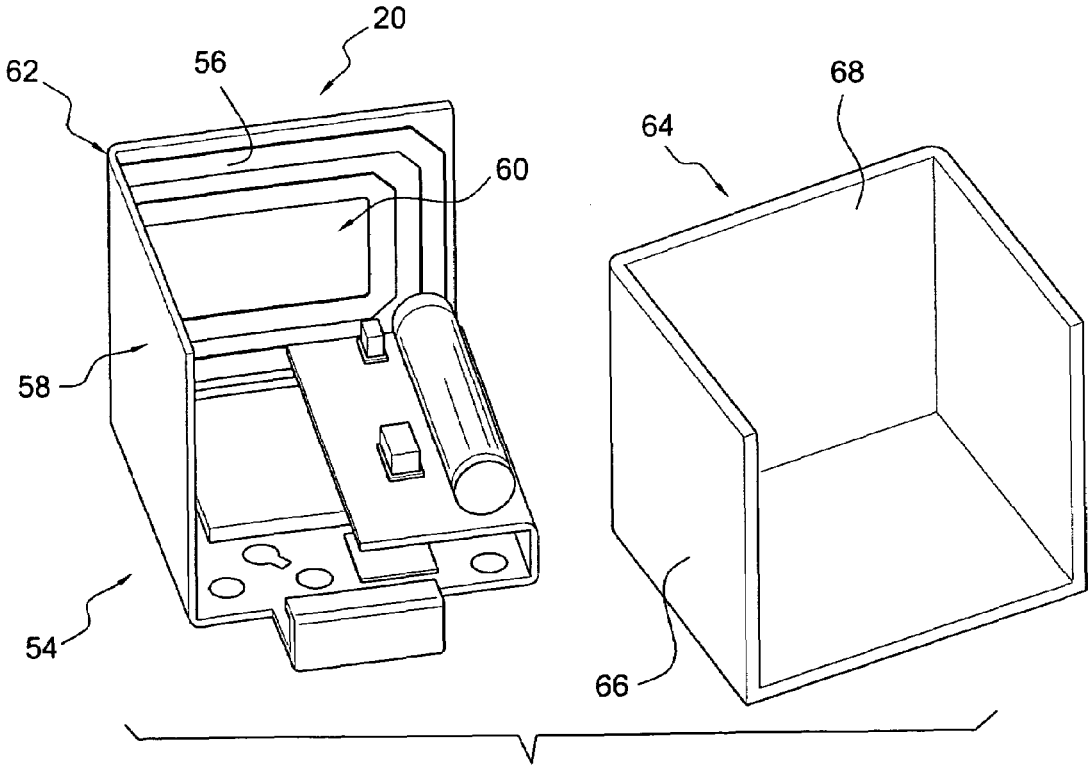
FIG. 4 is a perspective view of the flexprint assembly of FIG. 4 after having been folded for being mounted in the housing of the receiver device or the hearing instrument, respectively.

Such folded configuration is shown in FIG. 4. Usually the intermediate portion 62 will be relatively small, for example, less than 20% of the area of the antenna unit 20. Usually the first and second portion 58, 60 of the antenna will have essentially the same area and preferably will be essentially symmetrical with respect to each other. After the assembly has been brought—manually or automatically—into the folded condition shown in FIG. 4 it may be mounted within the housing 64 shown schematically in FIG. 4 (the housing 64 may correspond to the housing 18 of the receiver device 10 or the housing 52 of the hearing instrument 50). The assembly 54 will be mounted in the housing 64 in such a manner that the first portion 58 is adjacent to and aligned to a first wall 66 of the housing 64 and that the second portion 60 is adjacent to and aligned to a second wall 68 of the housing 64, whereby a particularly compact design resulting in a small volume can be achieved.

A further benefit consists in the fact that due to the angled configuration of the antenna 20 it is ensured that one half of the antenna is always directed into the optimum orientation with respect to the user's head (antenna plane usually perpendicular to the user's nose), whatever the orientation of the pins/socket of the audio shoe 14 relative to the housing 40 of the hearing instrument 16 may be. Preferably the antenna 20 is electrically connected to the respective signal processing unit 21 comprising the pre-amplifier 32 prior to mounting to the antenna 20 and the signal processing unit 21 within the housing 64, so that the antenna 20 with the HF-unit 29 and the pre-amplifier 32 can be trimmed prior to being mounted in the housing 64 (i.e. the resonant radio frequency circuits will be tuned in order to account for parasitic capacitances and inductances).

Figure 5:
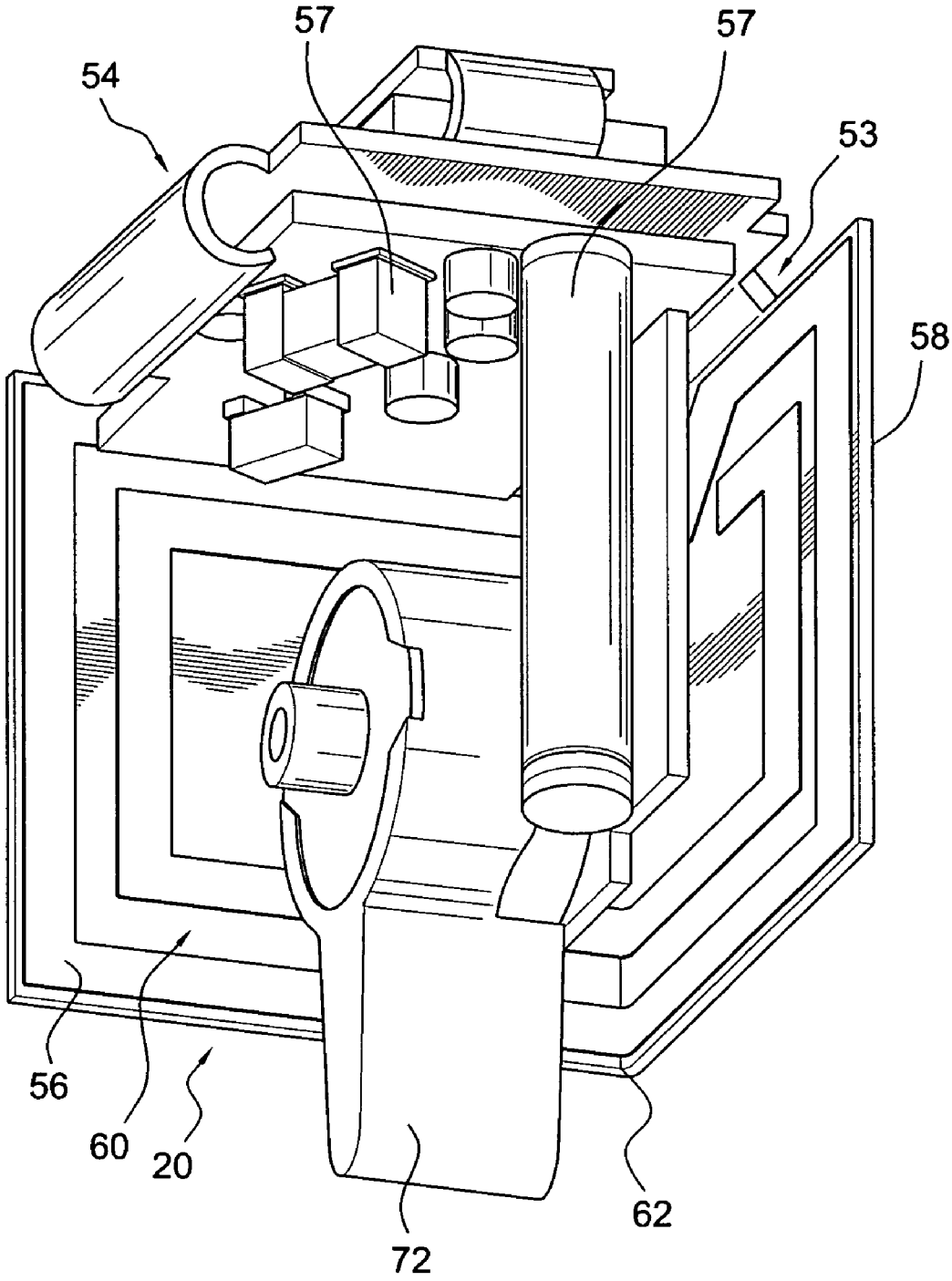
FIG. 5 is a view similar to that of FIG. 4, with another embodiment of a folded flexprint assembly being shown.

In FIG. 5 another example of a flexprint antenna assembly 54 is shown in its folded state prior to being mounted within the housing, which includes a switch 72 for manually switching between the operation modes FM and FM+M of the hearing instrument 16 connected to receiver device 10.

Figure 6:
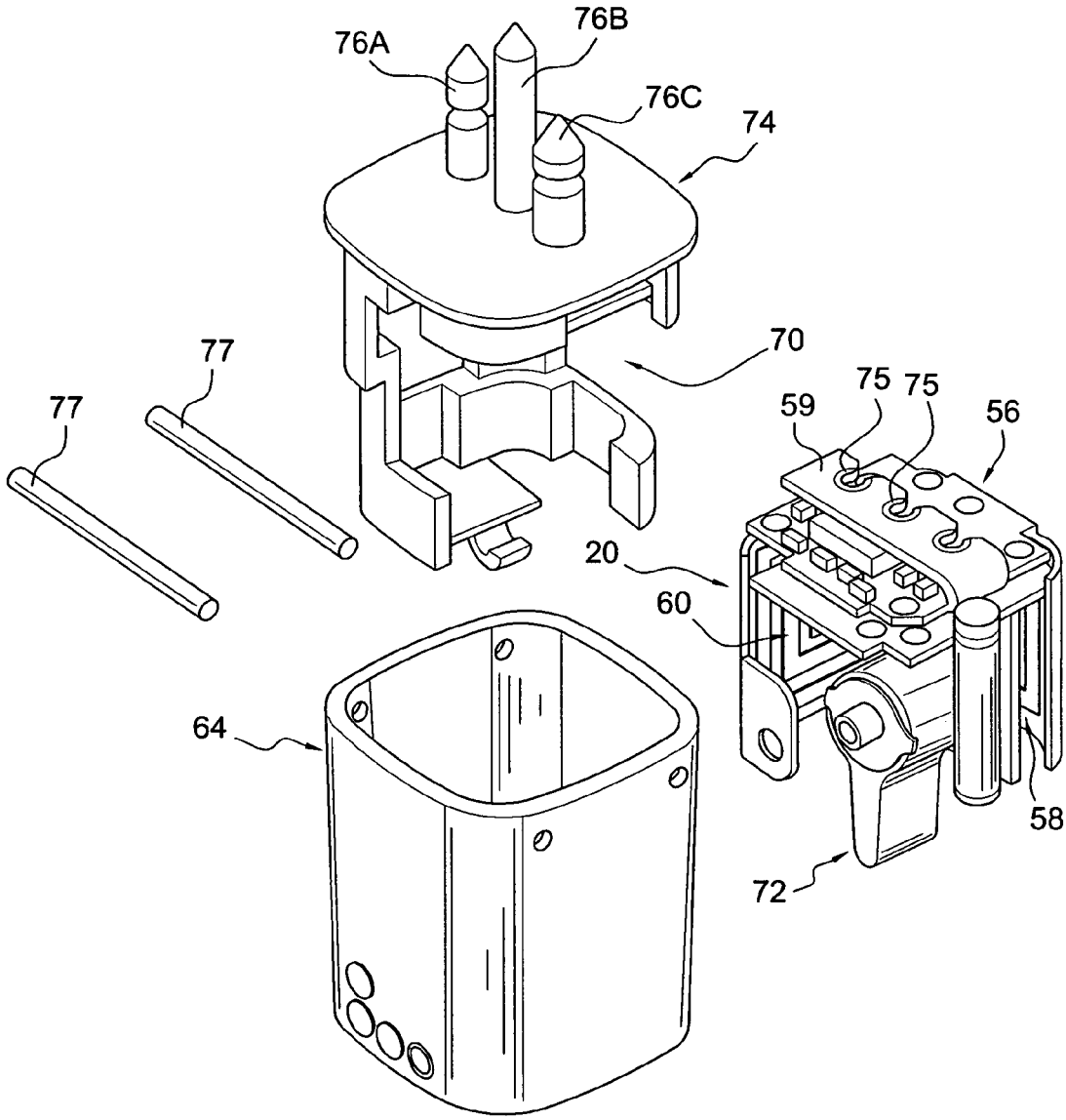
FIG. 6 is an exploded view of a receiver device comprising the folded flexprint assembly of FIG. 5, a housing and a plug member.

In FIG. 6 the folded flexprint assembly 54 of FIG. 5 (however, the conductor loops 56 of the antenna 20 have been omitted in FIG. 6) is shown together with a housing 64 and a plug member 74. The plug member 74 comprises three pins 76A, 76B, 76C which form the output interface 24 of the receiver unit 10 and which are arranged in a line so that they define a central symmetry plane of the output interface 24 (however, the pins 76A and 76C are of different diameters in order to ensure the plug member 74 can be connected to the audio shoe 14 only in the correct orientation—and not in an orientation rotated by 180 degrees with respect to the correct orientation). The plug member 74 also comprises a carrier unit 70 for receiving the folded assembly 54. For assembling the receiver device 10 the folded assembly 54 with the carrier unit is fixed at the carrier unit 70 of the plug member 74. The flexprint assembly 54 comprises contacts 75 which engage with the inner ends of the pins 76A, 76B, 76C upon when the assembly 54 is connected to the plug member 74. Finally the folded assembly 54 fixed at the plug member 74 is mounted within the housing 64. To this end the plug member 74 is fixed to the housing 64 by two rods 77, with the plug member 74 forming the cover plate of the housing 64.

Figure 7:
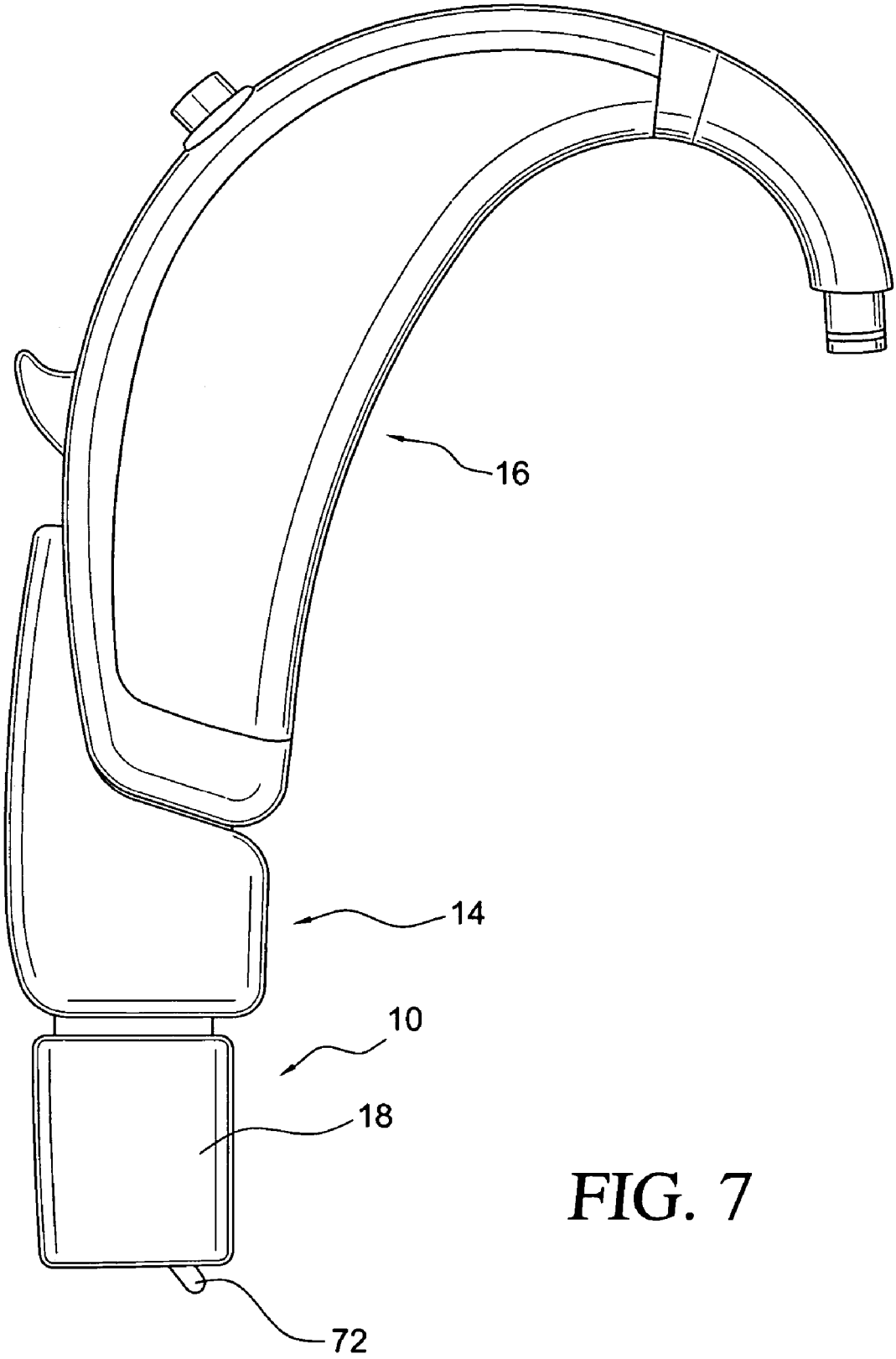
FIG. 7 is a side view of a hearing instrument with a receiver device being connected thereto via an audio shoe.

In FIG. 7 an arrangement is shown in which a receiver unit 10 comprising a housing 18 is connected via an audio shoe 14 to a hearing instrument 16, with the switch 72 projecting through the housing 18 for being operated by the user.

It is to be understood that, while the first portion 58 and the second portion 60 of the antenna 20 are shown in FIGS. 4 and 5 as being planar, this need not be necessarily so. In particular, if for design reasons the walls of the housing in which the antenna 20 is to be mounted have a rounded shape. the first portion 58 and the second portion 60 of the antenna 20 may have a correspondingly rounded shape. In this case the angle between the first and second portion of the antenna in the folded state may be determined by the angle between the respective tangential planes at the two opposite ends of the antenna (for example, if the antenna is bent in an "arch-like" manner in order to conform the shape of the antenna to a cylindrically shaped housing wherein the tangential planes at the two opposite ends of the bent antenna would form an angle of 90°, then the actual folding angle is 90°).

Figure 8:
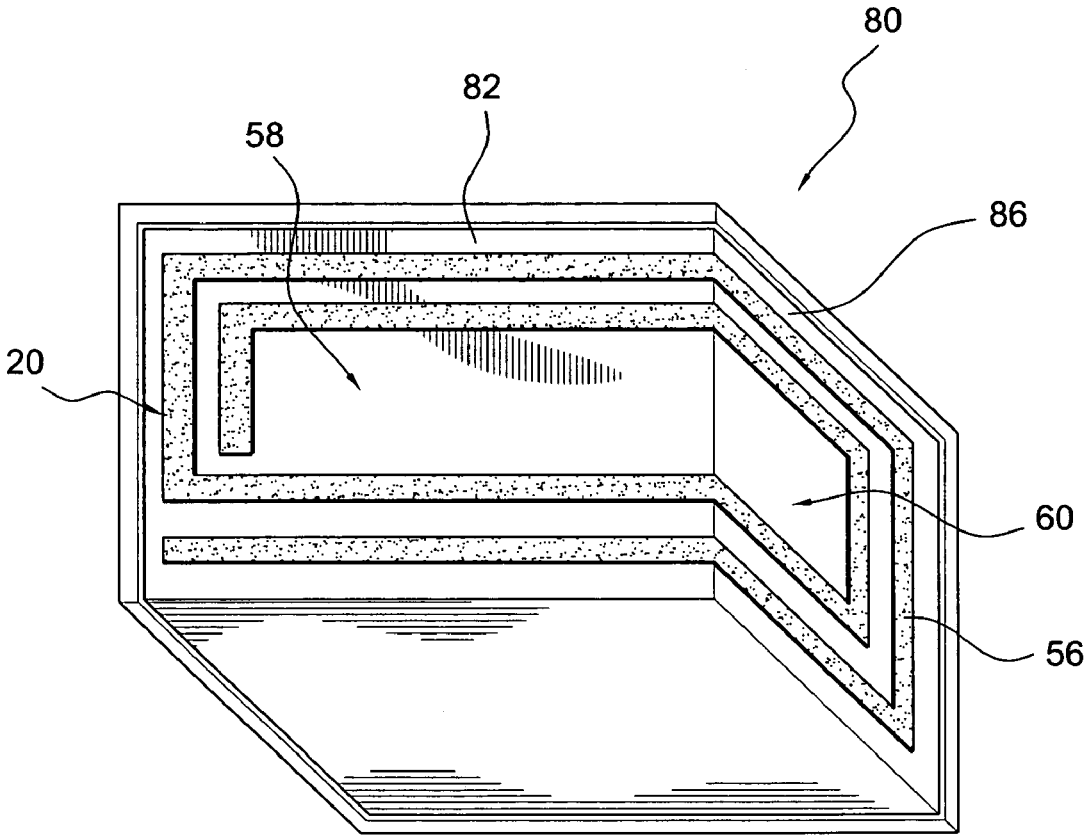
FIG. 8 shows an example of part of a housing of a receiver device or hearing instrument, with an antenna being integrated within the walls.

FIG. 8 shows an example of a housing 80 (only partially illustrated in the drawing) to be used for the receiver device 10 or for the hearing instrument 50 which capable of receiving audio signals from the remote source 12, into which housing 80 a magnetic loop antenna 20 has been integrated. As in the previous embodiments the antenna 20 comprises a loop-like conductor 56, with the conductor 56 being integrated into the walls of the housing 80. In the example shown in FIG. 7 the conductor 56 is integrated into a first wall portion 82 and a second wall portion 84, which are arranged at an angle of, for example, about 90° relative to each other. The antenna 20 is formed in such a manner that one half of the antenna is integrated into the first wall portion 82 while the second half of the antenna is integrated into the second wall portion 84, so that the two halves of the antenna, i.e. the first portion 58 of the antenna is oriented at an angle of about 90° relative to the second portion 60 of the antenna. The conductor 56 may be formed, for example, by one of the following methods within the housing 80 which is made of plastic material:

The housing is shaped first (for example, by injection moulding) and subsequently the conductor 56 is formed by modifying the surface of the housing 80. One possibility to achieve this is to use a plastic material for the housing 82 which is capable of being made conductive by laser activation, wherein the conductor 56 is created by laser activation of the respective surface portion of the plastic material of the housing 80, followed by electroplating of the laser activated surface portion in order to thicken the laser activated surface portion. According to an alternative process, the conductor 56 may be created by metal deposition from a metal evaporation source through a shadow mask onto a surface portion of the plastic material of the housing 80. According to another alternative process, the conductor 56 is created by coating at last a portion of the surface of the housing 80 with a metal layer, followed by selectively structuring the metal layer into the desired shape of the conductor 56, preferably by selectively removing the metal layer.

Rather than shaping the housing first and subsequently integrating the antenna structure, the antenna structure, i.e. the conductor 56, may be integrated into the housing 80 during shaping of the housing. This can be done, for example, by shaping the housing by injection moulding in a moulding tool, wherein the conductor is inserted into the moulding tool and is over-moulded in the moulding tool.

All of these techniques are known as moulded interconnect device (MID) techniques.

Figure 9:
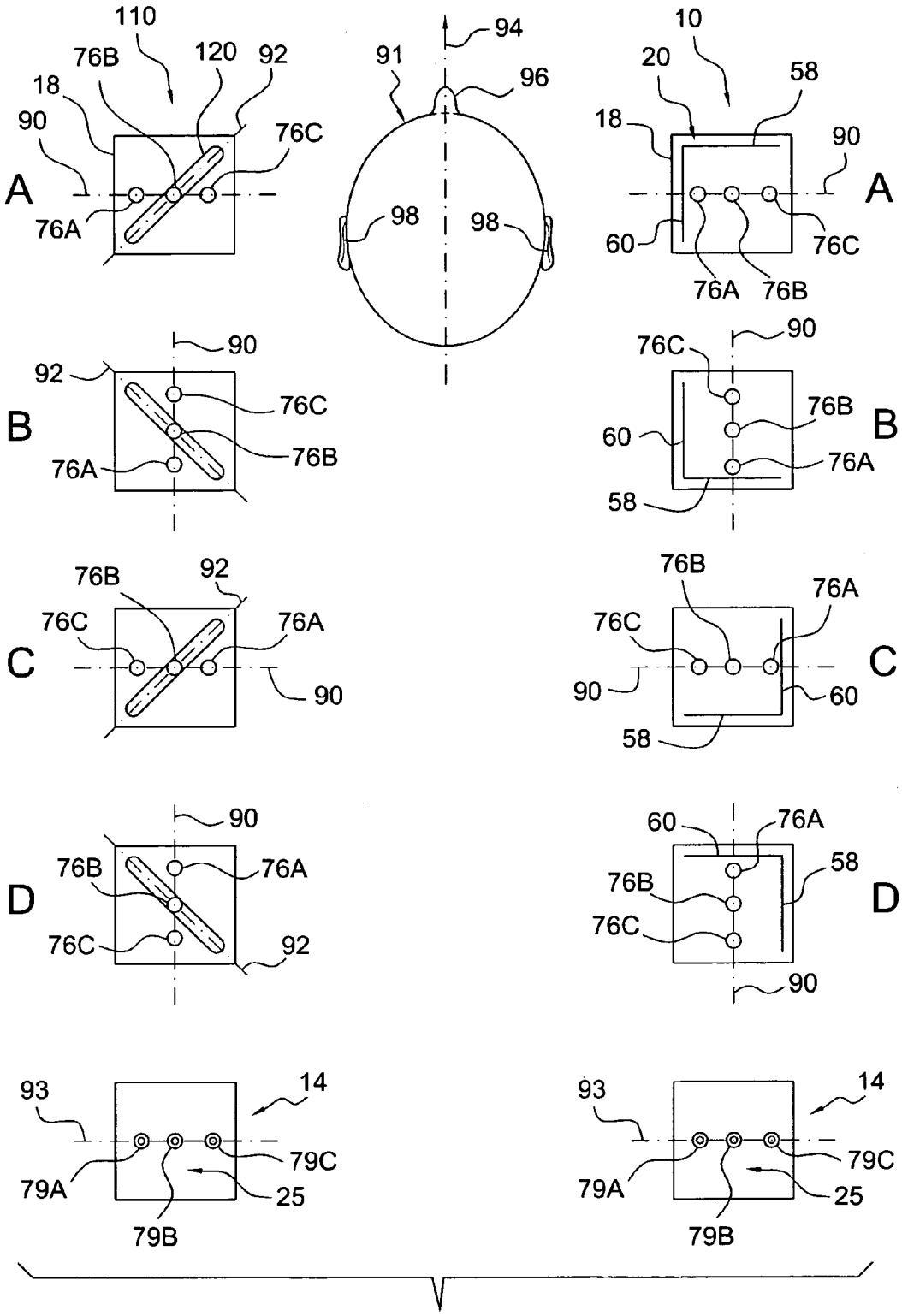
FIG. 9 is a schematic view of a receiver device comprising a non-angled antenna and of a receiver device comprising an angled antenna when used with four different types of audio shoes.

FIG. 9 is a schematic view of a receiver device 10 comprising an angled antenna 20 and of a receiver device 110 comprising a non-angled antenna 120, respectively, when used with four different types of audio shoes. In FIG. 9 the respective orientation of the antenna 20, 120 with respect to the direction 94 of the user's nose 96 is shown, with the direction 94 extending between the ears 98 through the nose tip.

The receiver device 10 comprises an essentially rectangular housing 18 with a plug member comprising three pins 76A, 76B and 76C which are arranged in a line, thereby defining a central symmetry plane 90 of the output interface of the receiver device 10. The angled antenna 20 is of the type shown in FIGS. 4 and 5, i.e. it comprises a first portion 58 which is angled by 90° relative to a second portion 60. In a first orientation labelled "A" in FIG. 9 the receiver unit 10 is used with a hearing instrument having an audio shoe of a first type which is oriented such that, when the receiver device 10 has been connected to the audio shoe and the hearing instrument is worn at the user's ear 98, the central plane 90 of the output interface of the receiver device 10 is perpendicular to the direction 94 of the user's nose 96. In this configuration, the first portion 58 of the antenna 20 likewise is oriented perpendicular to the direction 94 of the user's nose 96 so that the first portion 58 has an optimum orientation with respect to the user's head anatomy, while the second portion 60 has the least preferred orientation. In total, the antenna 20 thus will have medium sensitivity.

In the configuration labelled "B" in FIG. 9 the receiver device 10 is used with a different type of hearing instrument/audio shoe so that, when the receiver device 10 has been connected to the audio shoe and the hearing instrument is worn at the user's ear 98 the receiver device 10 has been rotated by 90° in the counter-clockwise direction compared to configuration A, so that the central symmetry plane 90 of the output interface now is parallel to the direction 94 of the user's nose 96. In this case the second portion 60 of the antenna 20 has the optimum orientation with respect to the direction 94 of the user's nose 96 while the first portion 58 now has the least preferred orientation. In total, however, the antenna performance thus is the same as in configuration A.

In the configuration labelled "C" the type of hearing instrument/audio shoe is such that the receiver device 10 has been rotated by 90° in the counter-clockwise direction compared to configuration B so that the central symmetry plane 90 now has the same orientation as in configuration A. Due to the 90° bent shape of the antenna 20, the performance of the antenna 20 is the same as in configurations A and B.

In the configuration labelled "D" the type of hearing instrument/audio shoe is such that the receiver device 10 has been rotated by 90° in the counter-clockwise direction compared to configuration C so that the central symmetry plane 90 now has the same orientation as in configuration B. Due to the 90° bent shape of the antenna 20, the performance of the antenna 20 is the same as in configurations A, B and C.

Consequently, by using an angled antenna 90, the performance of the antenna 20 is substantially independent of the specific type of hearing instrument/audio shoe with which the receiver device 10 is used.

An alternative embodiment in order to achieve such independence of antenna performance from the type of audio shoe is to use an antenna 120 which is either planar, thereby defining an antenna plane 92, or has an axial symmetry, thereby defining an antenna direction 92, wherein the antenna plane 92 or the antenna direction 92, respectively, is oriented at an angle of 30 to 60°, preferably from 40 to 50°, with respect to the central symmetry plane 90 of the output interface. If the antenna 120 is planar, it is preferably a magnetic loop antenna, whereas if it has an axial symmetry, it is preferably a ferrite antenna or an air coil antenna. Most preferably, the angle between the antenna direction 92 and the symmetry plane 90 of the output interface is about 45° as shown in FIG. 9. In this case, in configuration A, i.e. with the pins 76A to 76C being oriented such that the central symmetry plane 90 defined thereby is perpendicular to the direction 94 of the user's nose 96, the angle between the antenna direction 92 and the central symmetry plane 94 is 45°, resulting in medium performance of the antenna 120 compared to an orientation in which the antenna plane 92 or the antenna direction 92 would be perpendicular to the direction 94 of the user's nose 96.

In configuration B in which the orientation of the central symmetry plane 90 of the output interface has changed by 90° with respect to the direction 94 of the user's nose 96 due to the different type of audio shoe, the antenna direction 92 likewise has been rotated in the counter-clockwise direction by 90°. However, due to the angle of 45° between the antenna direction 92 and the central symmetry plane 90 of the output interface. the angle between the direction 94 of the user's nose 96 and the antenna direction 92 still is 45°. Consequently, the antenna performance will remain the same as in configuration A.

This also applies to configurations C and D in which the antenna 120, due to the 45° orientation with respect to the central symmetry plane 90, has the same orientation with respect to the user's head 91 as in configurations A and B, respectively.

Thus, by using an antenna 120 which is oriented such that the angle of the antenna direction 92 with respect to the central symmetry plane 90 of the output interface is around 45°, the antenna performance is essentially independent of the specific type of hearing instrument/audio shoe with which the receiver device 110 is used.

The housing 18 shown in FIG. 9, which corresponds to the housing 64 of FIG. 6, has a four-fold rotational symmetry with respect to an axial symmetry axis and comprises two walls which are parallel to the central symmetry plane 90 of the output interface and two walls which are perpendicular to the central symmetry plane 90.

Generally, apart from the different design of the antenna 120, the receiver device 110 may have the same architecture as the examples of the receiver device described so far.

Also shown in FIG. 9 is a schematic example of the input interface 25 of the audio shoe 14, which comprises three pin sockets 79A, 79B, 79C for receiving the pins 76A, 76B and 76C, respectively, which sockets are arranged in a line and thereby define a central symmetry plane 93 of the input interface 25. The input interface 25 shown in FIG. 9 is an example of an audio shoe of the type resulting in the configuration "A" of the receiver devices 10, 110 of FIG. 9.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A receiver device for receiving audio signals from a remote source, comprising: a magnetic loop antenna for receiving radio frequency signals carrying audio signals, a signal processing unit for reproducing audio signals from said radio frequency signals received by said antenna, an output interface which is capable of being mechanically connected to an input interface of a hearing instrument to be worn at a user's ear in order to supply said audio signals from said signal processing unit as input to said hearing instrument, and a housing enclosing said antenna and said signal processing unit, wherein said antenna is designed as a printed board circuit with a loop-like conductor on an at least partially flexible insulating substrate and comprises a first portion defining a first plane and a second portion defining a second plane, wherein said first plane and said second plane are oriented at an angle of 60 to 120 degrees relative to each other.

2. The receiver device of claim 1, wherein said first portion of said antenna is adjacent to and aligned to a first wall of said housing and said second portion of said antenna is adjacent to and aligned to a second wall of said housing.

3. The receiver device of claim 1, wherein said first portion and said second portion of said antenna are formed on a rigid portion of said substrate and are connected by a bent portion formed on a flexible portion of said substrate.

4. The receiver device of claim 1, wherein said first portion and said second portion of said antenna comprise at least 80% of an area of said antenna.

5. The receiver device of claim 4, wherein said first portion and said second portion of said antenna have essentially a same area.

6. The receiver device of claim 5, wherein said first portion and said second portion of said antenna are essentially symmetrical with respect to each other.

7. The receiver device of claim 1, wherein said conductor comprises one to three turns.

8. The receiver device of claim 1, wherein said angle between said first plane and said second plane is from 80 to 100 degrees.

9. A receiver device for receiving audio signals from a remote source, comprising:

a housing made of plastic material, a magnetic loop antenna for receiving radio frequency signals carrying audio signals, a signal processing unit for reproducing audio signals from said radio frequency signals received by said antenna, an output interface which is capable of being mechanically connected to an input interface of a hearing instrument to be worn at a user's ear in order to supply said audio signals from said signal processing unit as input to said hearing instrument, wherein said housing encloses said signal processing unit, wherein said antenna is formed by an angled portion of said housing into which a loop-like conductor forming a first antenna portion defining a first plane and a second antenna portion defining a second plane is integrated, and wherein said first plane and said second plane are oriented at an angle of 60 to 120 degrees relative to each other.

10. The receiver device of claim 9, wherein said first portion and said second portion of said antenna are connected by a bent portion of said antenna.

11. A hearing instrument to be worn at a user's ear and capable of receiving audio signals from a remote source, comprising: a magnetic loop antenna for receiving radio frequency signals carrying audio signals, a signal processing unit for reproducing audio signals from said radio frequency signals received by said antenna, an output transducer for stimulating a user's hearing according to said reproduced audio signals, and a housing enclosing said antenna and said signal processing unit, wherein said antenna is designed as a printed board circuit with a loop-like conductor on an at least partially flexible insulating substrate and comprises a first portion defining a first plane and a second portion defining a second plane, wherein said first plane and said second plane are oriented at an angle of 60 to 120 degrees relative to each other.

12. A hearing instrument to be worn at a user's ear and capable of receiving audio signals from a remote source, comprising: a housing made of plastic material, a magnetic loop antenna for receiving radio frequency signals carrying audio signals, a signal processing unit for reproducing audio signals from said radio frequency signals received by said antenna, an output transducer for stimulating a user's hearing according to said reproduced audio signals, wherein said housing encloses said signal processing unit, wherein said antenna is formed by an angled portion of said housing into which a loop-like conductor forming a first antenna portion defining a first plane and a second antenna portion defining a second plane is integrated, and wherein said first plane and said second plane are oriented at an angle of 60 to 120 degrees relative to each other.

* * * * *